US007227430B2

(12) United States Patent
Gill et al.

(10) Patent No.: US 7,227,430 B2
(45) Date of Patent: Jun. 5, 2007

(54) MULTICHIP MODULE

(75) Inventors: Hardial Singh Gill, Backnang (DE); Stefan Koch, Oppenweiler (DE); Rolf Lohrmann, Banknang (DE)

(73) Assignee: Marconi Communications GmbH, Backnang (DE)

( * ) Notice: Subject to any disclaimer, the term of this patent is extended or adjusted under 35 U.S.C. 154(b) by 16 days.

(21) Appl. No.: 10/495,290

(22) PCT Filed: Oct. 28, 2002

(86) PCT No.: PCT/IB02/04732

§ 371 (c)(1),
(2), (4) Date: Dec. 6, 2004

(87) PCT Pub. No.: WO03/043118

PCT Pub. Date: May 22, 2003

(65) Prior Publication Data

US 2005/0083150 A1 Apr. 21, 2005

(30) Foreign Application Priority Data

Nov. 14, 2001 (EP) ..... 01127087

(51) Int. Cl.
*H01P 5/12* (2006.01)

(52) U.S. Cl. ..... 333/136; 333/27; 333/236

(58) Field of Classification Search ..... 333/136, 333/27, 236

See application file for complete search history.

(56) References Cited

U.S. PATENT DOCUMENTS 3,176,237 A * 3/1965 Liger ..... 330/53
4,540,954 A * 9/1985 Apel ..... 330/286
4,754,234 A * 6/1988 Gamand ..... 330/286
5,357,212 A 10/1994 Kohno
5,412,339 A * 5/1995 Takano ..... 330/54
6,400,226 B2 * 6/2002 Sato ..... 330/286

OTHER PUBLICATIONS

*Optimum Microstrip Interconnects*, S. Nelson, et al., Microwave Symposium Digest, 1991., IEEE MTT-S International, Boston, MA, Jun. 10, 1991, New York, New York, pp. 1071-1074.

*Interconnects And Packaging of Millimeter Wave Circuits*, W. Menzel, Millimeter Waves, 1997 Topical Symposium on Kanagawa, Japan, Jul. 7-8, 1997, New York, New York, IEEE, pp. 55-58.

* cited by examiner

*Primary Examiner*—Robert Pascal
*Assistant Examiner*—Kimberly E Glenn
(74) *Attorney, Agent, or Firm*—Kirschstein, et al.

(57) ABSTRACT

A bondwire transition arrangement for interconnecting a signal port on one IC of a multichip module with a signal port on another, adjacent, IC of the same module employs a distributed signal-transition process in which the signal on one port appears as subsignals at tapping points along a series transmission-line segment arrangement between that port and ground on the same IC and the subsignals are recombined along a second series transmission-line segment arrangement connected between the other port and ground on the other IC. Spatially corresponding tapping points are interconnected via bondwires.

7 Claims, 2 Drawing Sheets

MULTICHIP MODULE

The invention relates to a multichip module having two or more microwave circuits which are interconnected by way of bondwires, and in particular a multichip module in which the microwave circuits are Monolithic Microwave Integrated Circuits (MMICs) or Microstripline Integrated Circuits (MICs).

Due to the ongoing demand for compact and small systems, more and more integrated circuits (ICs) are being used in microwave systems and subsystems. These ICs take the form of either MICs or MMICs. Although MMICs are the dominant components in the design of present and future microwave systems, in practice microwave systems comprise a mixture of these two components plus a number of lumped elements, e.g. inductors, resistors and capacitors, which cannot be integrated in the same way. These are all assembled together onto a Multichip Module (MCM), the various components being interconnected by means of bond- or leadwires.

The bondwires are kept as short as practicable as compared to the operating wavelength of the various circuits being interconnected, so that they do not affect the electrical characteristics of the MMICs or MICs at low frequency. Notwithstanding this, significant effects on electrical characteristics have been observed at high frequency, these characteristics including the scattering parameters and noise of the ICs. Thus the bondwire interconnection plays a major role in the design and integration of the multichip module, a role which the IC designer has to take into account.

The bondwire is most commonly considered as a lumped inductance, but this simple model is complicated at high frequencies due to the following factors:

(a) Parasitic capacitances are associated with the bondwire, not simply inductance.

(b) Where more than one bond wire is used in parallel there is a proximity effect, which complicates the picture.

(c) The presence of two or more dielectrics makes it even more difficult to calculate the dispersive properties of the interconnections.

(d) Bondwire resistance has to be taken into account and skin effect at high frequencies is especially significant; the high-frequency resistance may be many times its DC value.

The bondwire transition between the ICs is mainly made up of inductance together with some parasitic capacitance, and as such possesses an inherently low-pass characteristic. In order to be usable at high frequency a bondwire interconnection needs to be compensated. The following known methods are used to achieve this:

(1) The bond wires are kept as short as possible. FIG. 1 shows two IC chips 10 and 11, each having a signal port 12, 13 to which are connected respective transmission-line segments 14, 15 which terminate in respective bondpads 16, 17 very near the edge of the chips. Joining the two bondpads is a short bondwire 18. There are physical limitations to this scheme, however; for example, it is difficult to realise in cascaded assemblies due to manufacturing tolerances.

(2) Two or more bondwires are connected in parallel to reduce the inductance (see FIG. 2), but that requires a bigger bondpad, which in turn means a larger parasitic capacitance, and this again limits the bandwidth.

(3) One or two lumped capacitances 19, 20 are attached in series with the bondwire as shown in FIG. 3. This gives rise to a bandpass characteristic, with the result that such transitions can be used only in a limited bandwidth. A further drawback is that the MIM-type capacitors, which are commonly used in MMIC technology, cannot be bonded at their top plate due to the thinness of the dielectric used in such capacitors. This transition arrangement can, however, be employed in MIC-to-MIC interconnections if lumped capacitors such as Di-caps® are used.

(4) Where more than one bondwire is employed, a large bondpad called a "T-shaped flare" may be used on each chip (see FIG. 2, where the two flares are shown as items 21 and 22). The capacitors shown are the open-end capacitances of the open-circuit stubs part of the flare. These capacitances are, in fact, parasitic bond-pad capacitances. Though this configuration is very common, it is limited in bandwidth due to its low-pass characteristics.

In accordance with a first aspect of the invention there is provided a multi-chip module comprising adjacently disposed first and second microwave circuits having respective first and second signal ports and respective first and second reference-potential points, there being connected between the first signal port and the first reference-potential point a first series arrangement of N transmission-line segments having N−1 sequential tapping points, and between the second signal port and the second reference-potential point a second series arrangement of transmission-line segments having N−1 sequential tapping points, wherein the signal-port end of the first series arrangement corresponds spatially to the reference-potential end of the second series arrangement and the signal-port end of the second series arrangement corresponds spatially to the reference-potential end of the first series arrangement, and likewise spatially corresponding pairs of tapping points are connected together by way of respective bond wires.

Preferably for at least one of the first and second series arrangements, the transmission-line segment nearest to the signal port is a bend.

Advantageously the first and second series arrangements are open-circuited. Preferably in such an arrangement for at least one of the first and second series arrangements, an open-circuit capacitance is provided at the reference-potential end of the arrangement.

Preferably the microwave circuits are monolithic microwave integrated circuits (MMICs) or microstripline integrated circuits (MICs).

According to a second aspect of the invention there is provided a method for interfacing a signal on a first signal port of one IC of a multichip module with a second signal port of another, adjacent, IC of the same multichip module, comprising: decomposing the signal into a plurality of subsignals in a first transmission-line arrangement; feeding the subsignals via bondwires to a second transmission-line arrangement; and recombining in the second transmission-line arrangement the thus fed subsignals into a combined signal at the second signal port.

An embodiment of the invention will now be described, by way of example only, with reference to the drawings, of which:

Figure 1:
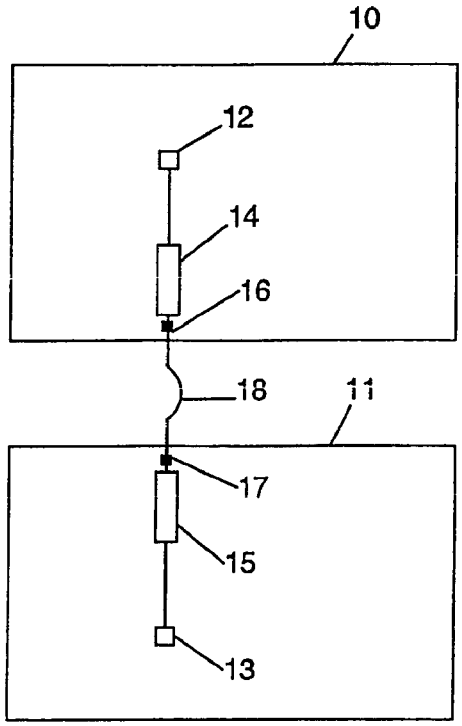
FIGS. 1, 2 and 3 are examples of known bondwire interconnections between integrated circuits.
Figure 3:
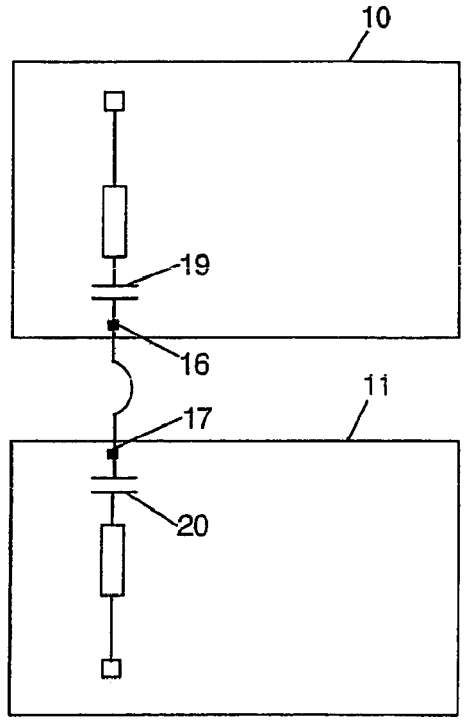
Figure 2:
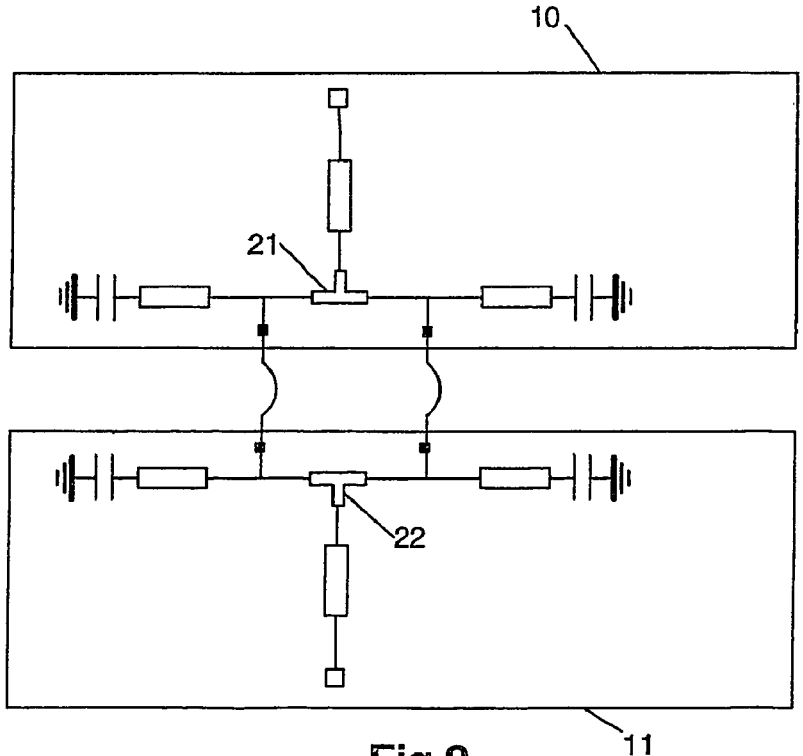
Figure 4:
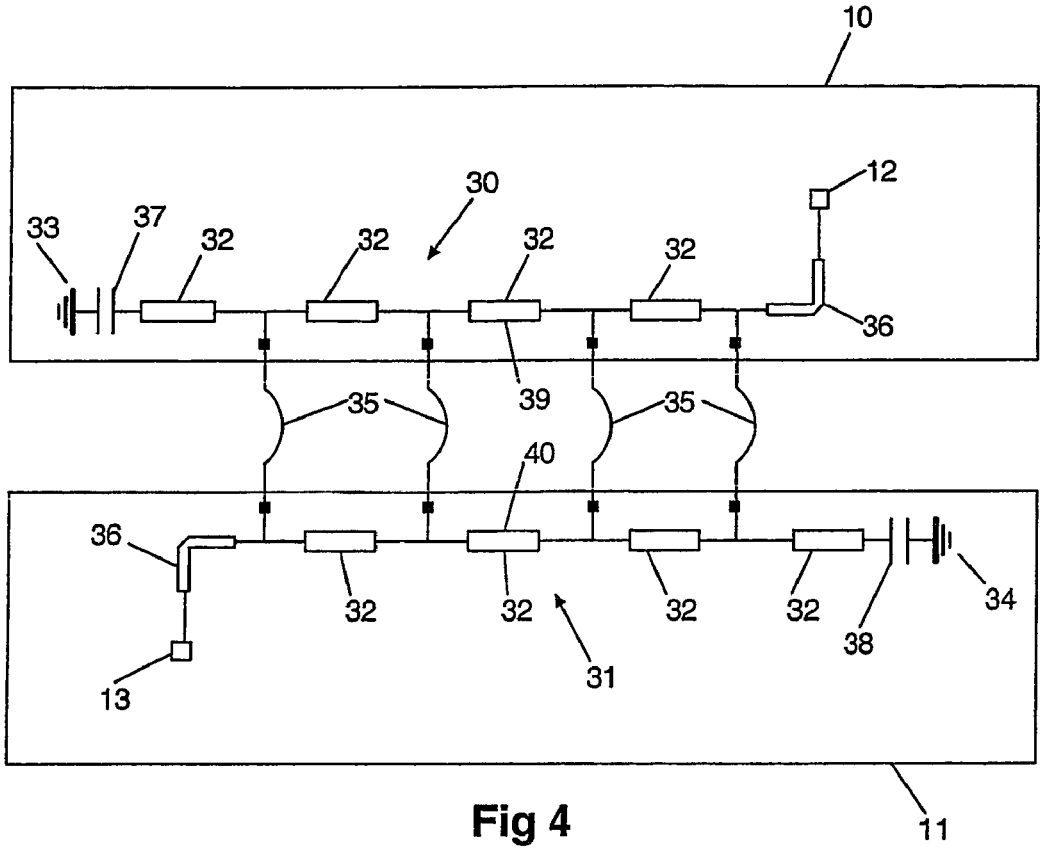
FIG. 4 is a circuit diagram of a bondwire transition in accordance with the present invention.

Referring now to FIG. 4, an embodiment of the invention will now be described.

As already described in the previous examples, two IC chips 10 and 11 (MMIC or MIC circuits) have respective signal ports 12, 13 which are to be interconnected using bondwires. In this case, however, a distributed form of transition is achieved by the provision of respective series arrangements 30, 31 of transmission-line segments 32 connected between the signal ports 12, 13 and reference-potential (ground) points 33, 34. The underside of each MMIC or MIC circuit is at ground potential. The actual transition is accomplished by connecting the various tapping points along one series arrangement 30 to the spatially corresponding tapping points along the other series arrangement 31 by means of bondwires 35. By arranging for the various tapping-point pairs to be directly opposite each other, it can be ensured that the bondwires are as short as possible, which has already been shown to be desirable. It is important to note in this configuration that the signal-port end of series arrangement 30 lies more or less opposite the non-signal-port end of series arrangement 31, and vice-versa.

In this configuration, then, where the signal ports 12 and 13 are, for example, an output port and an input port, respectively, the output signal to the series arrangement 30 is distributed to all the bond-wire connections 35 and the thus created subsignals are again combined, via series arrangement 31, into one signal at the input port 13 of IC 11.

Figure 5:
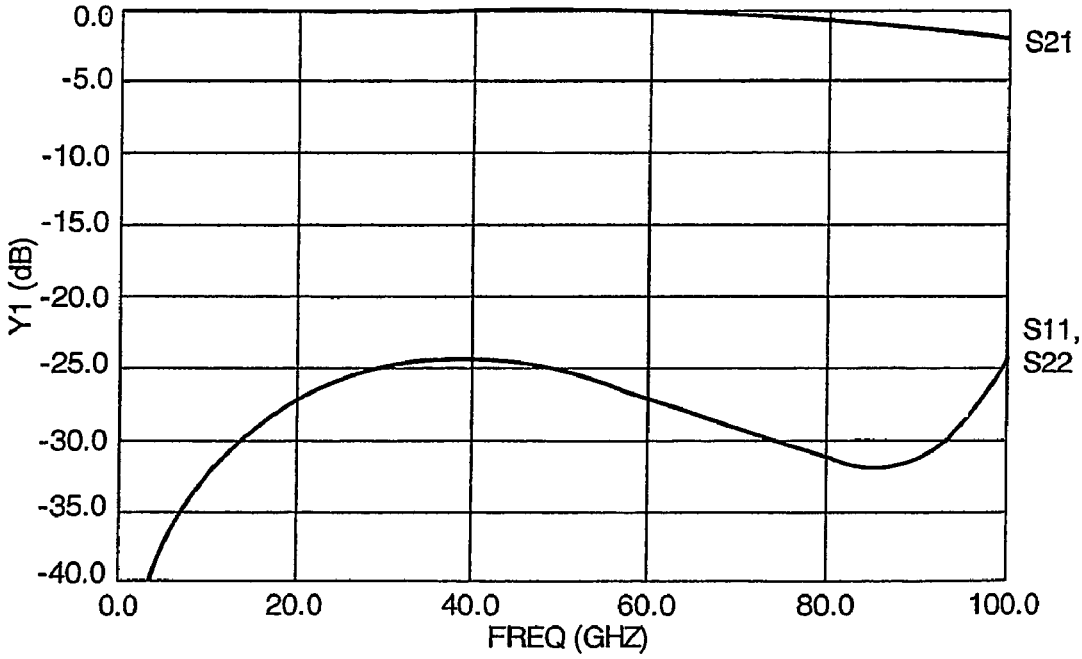
FIG. 5 is a diagram illustrating various performance characteristics associated with the bondwire transition of FIG. 4.

This type of interconnection is very broadband due to the distributed nature of the transition. An idea of the typical performance of the interconnection is given in FIG. 5, in which the magnitude (in dB) of various S-parameters associated with the transition scheme are plotted against frequency.

In the actual embodiment shown in FIG. 4 a total of five transmission-line segments are shown in each series arrangement 30, 31, with the segment nearest the signal port in each case being a mitred bend 36. The last transmission-line section 32 nearest the ground end 33 is in each case an open-circuit stub and the capacitances 37 and 38 are the open-end capacitances of these stubs. Depending on the layout of the particular IC chips involved, a mitred bend might not be needed, also the number of segments may be more or less than the five shown. The number of bond wires 35 and transmission lines 32 are the criteria which determine the bandwidth and reflection coefficient of the transition.

In practice the parameter-values of the various transmission-line segments 32 of the series arrangement 30 may be different from each other, and likewise the parameter-values of the segments 32 of the series arrangement 31. Also the parameter values of corresponding segments, e.g. segments 39 and 40, may be different from each other. The design is based upon a multiple branch line zero-dB coupler, where bond-wires 35 are branch lines and lines 30 and 31 are through- and coupled lines. The coupled and isolated ports are terminated in open-circuit capacitances 37 and 38.

The invention claimed is:

1. A multi-chip module, comprising:

a) adjacently disposed first and second microwave circuits having respective first and second signal ports and respective first and second reference-potential points;

b) a first series arrangement of N transmission-line segments having N−1 sequential tapping points being connected between the first signal port and the first reference-potential point;

c) a second series arrangement of transmission-line segments having N−1 sequential tapping points being connected between the second signal port and the second reference-potential point;

d) the first series arrangement having a signal-port end which corresponds spatially to a reference-potential end of the second series arrangement;

e) the second series arrangement having a signal-port end which corresponds spatially to a reference-potential end of the first series arrangement; and f) likewise spatially corresponding pairs of tapping points being directly connected together by way of respective bond wires.

2. The multi-chip module as claimed in claim 1, wherein, for at least one of the first and second series arrangements, a transmission-line segment nearest to at least one of the signal ports is a bend.

3. The multi-chip module as claimed in claim 1, wherein the first and second series arrangements are open-circuited.

4. The multi-chip module as claimed in claim 3, wherein, for at least one of the first and second series arrangements, an open-circuit capacitance is provided at the reference-potential end of said at least one arrangement.

5. The multi-chip module as claimed in claim 1, wherein the microwave circuits are monolithic microwave integrated circuits (MMICs).

6. The multi-chip module as claimed in claim 1, wherein the microwave circuits are microstripline integrated circuits (MICS).

7. A method of interfacing a signal on a first signal port of one integrated circuit (IC) of a multi-chip module with a second signal port of another, adjacent, IC of the same multi-chip module, comprising the steps of:

a) decomposing the signal into a plurality of subsignals in a first transmission-line arrangement;

b) feeding the subsignals from the first transmission-line arrangement directly via bondwires to a second transmission-line arrangement; and c) recombining in the second transmission-line arrangement the thus fed subsignals into a combined signal at the second signal port.

* * * * *